US005766448A

United States Patent [19]

Markham

[11] Patent Number: 5,766,448

[45] Date of Patent: Jun. 16, 1998

[54] PRESSURE SCREENING SYSTEM FOR PROCESSING CONTAMINATED PULP FIBER

[75] Inventor: Larry D. Markham, Mobile, Ala.

[73] Assignee: International Paper Company, Tuxedo, N.Y.

[21] Appl. No.: 710,989

[22] Filed: Sep. 25, 1996

[51] Int. Cl.[6] ..... B03D 1/24; B03B 7/00

[52] U.S. Cl. ..... 209/168; 209/17; 209/170; 162/4; 210/221.2; 210/295

[58] Field of Search ..... 209/17, 170, 169, 209/168; 162/4; 210/221.2, 221.1, 295, 202

[56] References Cited

U.S. PATENT DOCUMENTS

| | | | |
|---|---|---|---|
| 2,005,742 | 6/1935 | Hines . | |
| 4,157,952 | 6/1979 | Krofta | 209/170 |
| 4,202,761 | 5/1980 | Holz . | |
| 4,231,841 | 11/1980 | Calmanti et al. | 162/5 |
| 4,399,028 | 8/1983 | Kile et al. | 209/164 |
| 4,548,673 | 10/1985 | Nanda et al. | 162/4 |
| 4,620,671 | 11/1986 | Skaar . | |
| 5,015,367 | 5/1991 | Klimpel et al. | 209/166 |
| 5,022,984 | 6/1991 | Pimley et al. | 209/170 |
| 5,028,315 | 7/1991 | Cruea et al. | 209/164 |
| 5,173,176 | 12/1992 | Klimpel et al. | 209/166 |
| 5,279,424 | 1/1994 | Britz et al. | 209/170 |
| 5,308,448 | 5/1994 | Behler et al. | 162/7 |
| 5,358,605 | 10/1994 | Dorflinger . | |
| 5,381,906 | 1/1995 | Satomi . | |
| 5,391,261 | 2/1995 | Van Den Bergh | 162/4 |
| 5,417,806 | 5/1995 | Matzke . | |
| 5,580,446 | 12/1996 | Markham . | |

*Primary Examiner*—Thomas M. Lithgow
*Attorney, Agent, or Firm*—Ostrager Chong Flaherty & Onofrio

[57] ABSTRACT

A pressure screening system for processing contaminated pulp fiber including a pressure screen apparatus for separating an accepts stream of clean fiber from a rejects stream carrying contaminants, and a feed tank for supplying a pulp fiber slurry to the inlet of the pressure screen apparatus, wherein the feed tank has a flotation section for receiving the rejects stream together with air for generating a froth separating a rejects overflow of contaminants from the remainder of the feed stock for recovery of additional pulp fiber from the rejects stream. The air may be contained in the rejects stream when it enters the flotation section, or it may be introduced at or near the input to the flotation section. The feed tank with flotation section can receive the rejects streams from multiple pressure screen stages, or a separate feed tank can be used for each pressure screen stage. The improved system reduces pulp fiber losses and reduces the equipment cost and complexity of the conventional feed tank and rejects stream handling arrangement. The flotation section is preferably formed as a standpipe connected to the feed tank, or may be a separate flotation cell coupled through a pump or a valve to the feed tank.

20 Claims, 4 Drawing Sheets

PRESSURE SCREENING SYSTEM FOR PROCESSING CONTAMINATED PULP FIBER

FIELD OF THE INVENTION

This invention generally relates to technology for processing contaminated pulp fiber, and more particularly, to an improved pressure screening system having a feed tank which uses pulp fiber from a rejects stream.

BACKGROUND OF INVENTION

A conventional pressure screen apparatus for recycled fiber employs a screen basket and rotor to separate an input feed of repulped fiber into a filtered accepts stream of substantially clean pulp and a rejects stream carrying off ink particles or other contaminants. A feed tank may be used to supply the input pulp feed to the pressure screen apparatus. Successive pressure screen stages may be arranged to recover additional pulp fiber from the rejects stream supplied from a preceeding stage.

If a secondary or successive pressure screen stage is used to recover additional pulp fiber from a rejects stream of an upstream stage, the downstream stage typically employs a feed tank which receives the rejects stream from the upstream stage, then the accepts stream from the downstream pressure screen stage is fed back to the feed tank for the upstream stage or else is fed forward in the system together with the accepts from the upstream screen.

It has also been known to use injected air to assist with the separation of repulped fiber from ink particles and other contaminants. For example, an improved pressure screen apparatus of the same inventor, disclosed in U.S. patent application Ser. No. 08/332,324 filed on Oct. 20, 1994, now U.S. Pat. No. 5,580,446 issued Dec. 3, 1996, which is incorporated herein by reference, employs an input pulp feed with entrained air bubbles and a vortex created by the rotor of the pressure screen to enhance the removal of ink particles carried off by the air bubbles in the rejects stream.

Another kind of deinking technology employs a flotation tank and centrifugal force and/or injected air for separation of repulped fiber from ink particles or other contaminants. For example, U.S. Pat. No. 2,005,742 to Hines, U.S. Pat. No. 4,548,673 to Nanda, U.S. Pat. No. 5,022,984 to Pimley, and U.S. Pat. No. 5,279,424 to Britz all disclose the introduction of air near the pulp stock inlet of a flotation tank to enhance the creation of froth for carrying off ink particles. U.S. Pat. No. 4,157,952 to Krofta discloses the introduction of repulped slurry tangentially through injector nozzles provided with air inlets in a flotation tank for creating a swirling rotation of the slurry for removal of ink-carrying froth from a central overflow wier. U.S. Pat. No. 4,399,028 to Kile and U.S. Pat. No. 5,028,315 to Cruea disclose vertically stacked flotation cells for recovering fiber from the overflow of the cells in stages.

However, the conventional technology requires fairly complex equipment in order to obtain a good ratio of recovered fiber and efficiency in contaminant removal. It is a principal object of the present invention to simplify the design and reduce the costs of pressure screening systems, while at the same time reduce the loss of good pulp fiber in the rejects stream and improve the efficiency of contaminants removal. Another object is to remove even small contaminants which cannot be removed by conventional screening.

SUMMARY OF INVENTION

In accordance with the present invention, a pressure screening system for processing contaminated pulp fiber is provided. The system comprises a pressure screen apparatus having an inlet for an input feed of a pulp fiber slurry and a screen member for separating an accepts stream of clean fiber from a rejects stream carrying contaminants, and a feed tank having a primary input for a feed of pulp fiber and an output for supplying pulp fiber slurry to the inlet of the pressure screen apparatus. The feed tank includes a flotation section for receiving a rejects stream of the pressure screening system fed through a secondary input to said flotation section together with air for generating a froth separating a rejects overflow of contaminants from the remainder of the feed stock for recovery of additional pulp fiber from said rejects stream.

The invention may be used in processing any type of pulp fiber preferably recycled fiber or contaminated virgin fiber. The contaminants in the reject stream typically contain ink particles, other types of particles, including but not limited to wax and other colloidal materials, stickies, plastics and hot melt adhesives, light weight particles, hydrophobic particles, as well as flotable types of particles, including but not limited to wood particles, i.e. wood floats.

Air may be contained in the rejects stream when it enters the flotation section when, for example, the previously-referenced improved pressure screen apparatus of the same inventor employing entrained air bubbles in its input feed is used. If a conventional pressure screen is used, the air can be introduced into the rejects stream at or near the secondary input to the flotation section or into the flotation section itself. The resulting froth generated by the air in the flotation section carries off a high concentration of contaminant particles in the rejects overflow from the feed tank and is discarded. The residual pulp from the rejects stream enters an enlarged mixing area of the feed tank where it is combined with the remainder of the feed stock for input to the pressure screen apparatus.

Various system configurations may be used, including use of the same primary feed tank to receive the rejects streams from successive pressure screen stages, or the use of separate feed tanks for cycling back the rejects stream from respective pressure screen stages. The improved system reduces pulp fiber losses and reduces the equipment cost and complexity of the conventional feed tank and rejects stream handling arrangement.

The flotation section is preferably formed as a standpipe connected to the feed tank. A separate flotation cell may also be used. Dilution water may be introduced into the standpipe adjacent the rejects stream input in order to minimize the pulp consistency and increase the flow velocity and froth. The preferred consistency of the rejects stream is in the range of 0.4–3.0%, and preferably 0.6–2.0%. A small-diameter standpipe is preferred. A controlled volume overflow is provided with room for expansion at the top. There must be enough entrained air to ensure flotation of the contaminant-carrying froth, and air may be added into the rejects stream or near the secondary input to the flotation tank for the rejects stream or into the flotation tank itself. Provision may also be made for handling surges of feed stock demand and possible upset conditions in the pressure screen. A suitable flotation chemical may be added to the feed tank to make the contaminants more hydrophobic so that they become more strongly attached to the air bubbles and to increase the amount of foam.

Other objects, features, and advantages of the present invention will be explained in the following detailed description of the invention having reference to the appended drawings.

DETAILED DESCRIPTION OF INVENTION

Figure 1A:
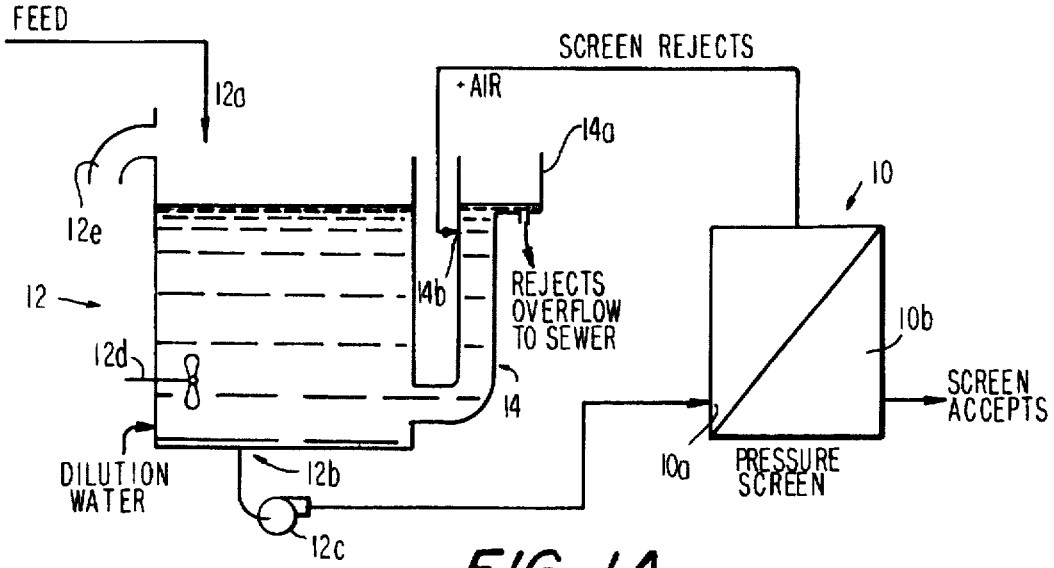
FIG. 1*a* is a schematic diagram of a basic pressure screening system employing a pressure screen apparatus and a feed tank with a flotation section and secondary input for cycling back the rejects stream from the pressure screen apparatus in accordance with the present invention.

In FIG. 1*a*, a pressure screening system for processing contaminated pulp fiber in accordance with the present invention is illustrated. The system comprises a pressure screen apparatus 10 having an inlet 10*a* for a pulp fiber slurry and a screen member 10*b* for separating an accepts stream of clean fiber from a rejects stream carrying contaminants, and an associated feed tank 12 having a primary input 12*a* for a feed of pulp fiber and an output 12*b* for supplying pulp fiber slurry to the inlet of the pressure screen apparatus 10. The feed tank may also include an input for dilution water, an agitator 12*d* for mixing the pulp feed to a uniform consistency, and an overflow pipe 12*e*.

The feed tank 12 includes a flotation section 14 for separating a rejects overflow of contaminants from the remainder of the feed stock. In this figure, the flotation section is depicted in the form of a standpipe having a head portion 14*a* for containing a froth generated for the rejects overflow and discharging it to the sewer. The rejects stream from the pressure screen is fed back together with air through a secondary input 14*b* to the flotation section of the feed tank.

The air may be contained in the rejects stream when it is drawn off from the pressure screen if an apparatus of the type disclosed in commonly owned U.S. patent application Ser. No. 08/332,324 filed on Oct. 20, 1994, now issued as U.S. Pat. No. 5,580,446 on Dec. 3, 1996, of the same inventor is used. In such a pressure screen apparatus, air bubbles are injected or entrained with the input feed to the pressure screen and are used in the vortex generated by the pressure screen to create a rising spiral of air bubbles carrying contaminants upward through the screen to the rejects outlet. The rejects stream exiting the screen outlet and cycled back to the flotation section 14 of the feed tank 12 contains a substantial volume of air in it. This air can be remixed prior to the flotation section using a motionless mixer or a mechanical mixer or an orifice plate. If additional air is required, it can be injected into the rejects stream or introduced at or near the secondary input 14*b* to the flotation cell or can be added by sparging into the flotation column or flotation cell. In the case of a conventional pressure screen apparatus not employing entrained air with the input feed, the required amount of air can be injected or introduced in this manner.

The air in the rejects stream input to the flotation cell causes air bubbles to rise upwardly in a froth to the head portion 14*a* carrying contaminants in a high concentration. The froth is drawn off as a rejects overflow from the feed tank and discarded to the sewer. The remaining pulp fiber in the rejects stream is combined and mixed with the feed stock in the tank 12 and fed to the inlet of the pressure screen apparatus. In this manner, the air in the rejects stream is used to separate off the contaminants, while the residual fiber in the rejects stream is combined with the feed stock in order to reduce fiber losses.

Figure 2:
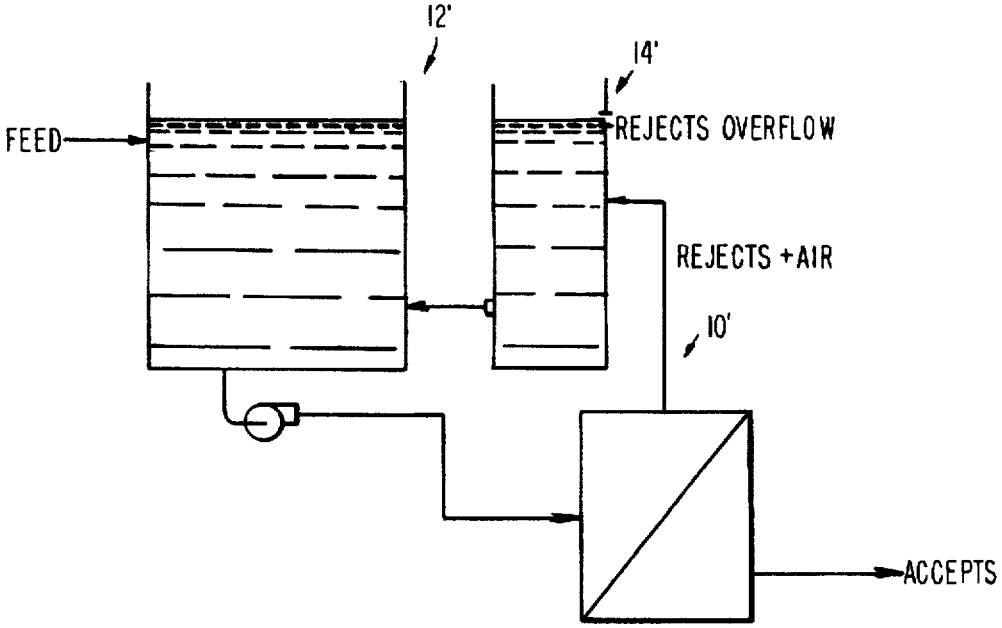
FIG. 2 is a schematic diagram of an alternate feed tank embodiment having a separate flotation cell.

Another embodiment of the basic system of the invention is shown in FIG. 2. The system has a pressure screen 10' and feed tank 12' as above, however the flotation section is a separate flotation cell 14'. A rejects overflow is drawn off from the flotation cell 14', while the residual pulp is fed to the feed tank 12' by means of gravity flow through a valve or by means of a pump, where it is mixed with the feed stock for input to the pressure screen.

Figure 3:
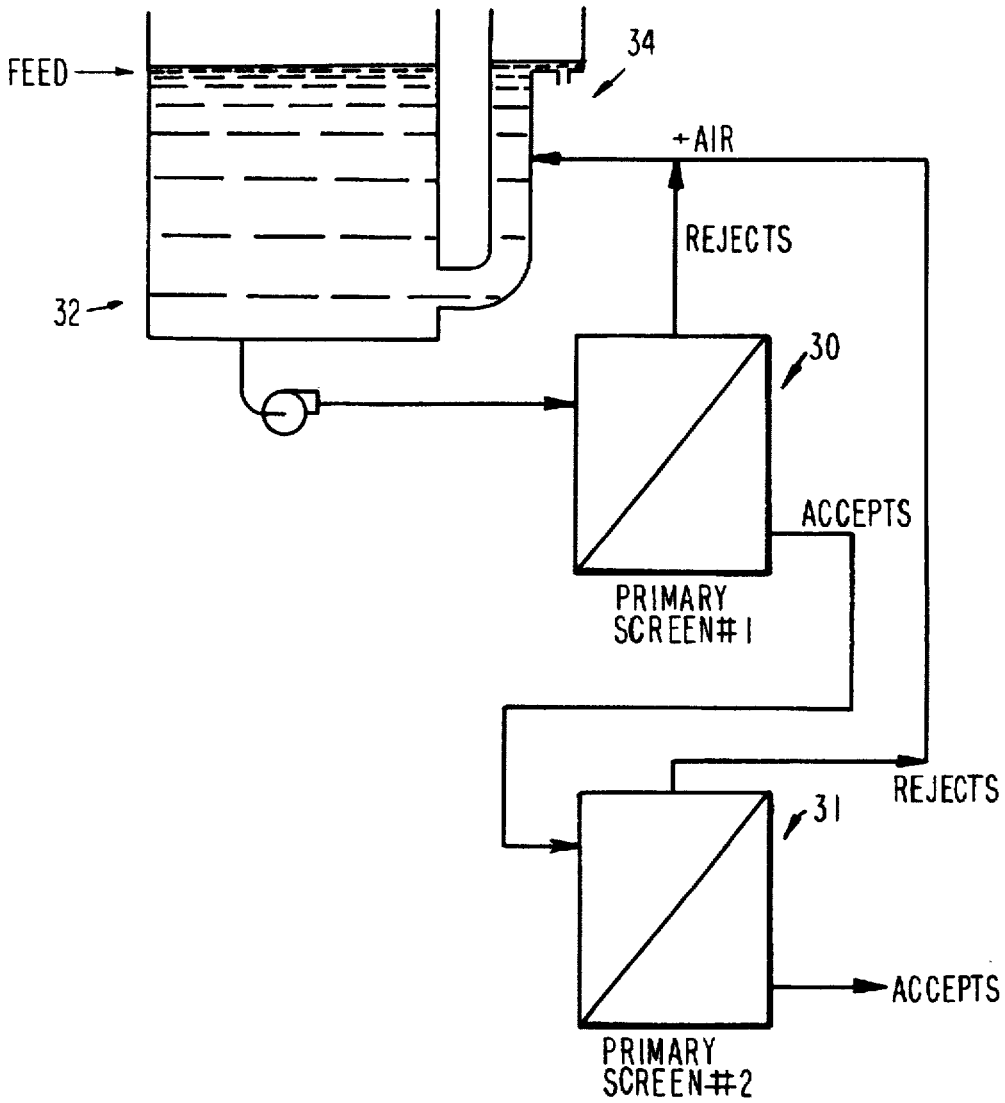
FIG. 3 is a schematic diagram of a pressure screening system employing multiple pressure screen stages and a single feed tank with a flotation section for receiving the rejects streams from the multiple pressure screen stages.

A multi-stage embodiment of the system of the invention is shown in FIG. 3. One feed tank 32 with a flotation section 34 is used to feed a first primary screen 30 and a second primary screen 31 arranged in series, and receives the rejects streams from both screens. The accepts stream from the first primary screen 30 is input to the second primary screen 31, and the accepts stream from the second primary screen is taken as the accepts output. Additional screens can be added in series with the first two if higher screening efficiency is required. The advantage of series screening is that a very high contaminant removal can be achieved, so that clean pulp can be produced from very low quality pulp. This allows low cost waste paper to be used.

Figure 1B:
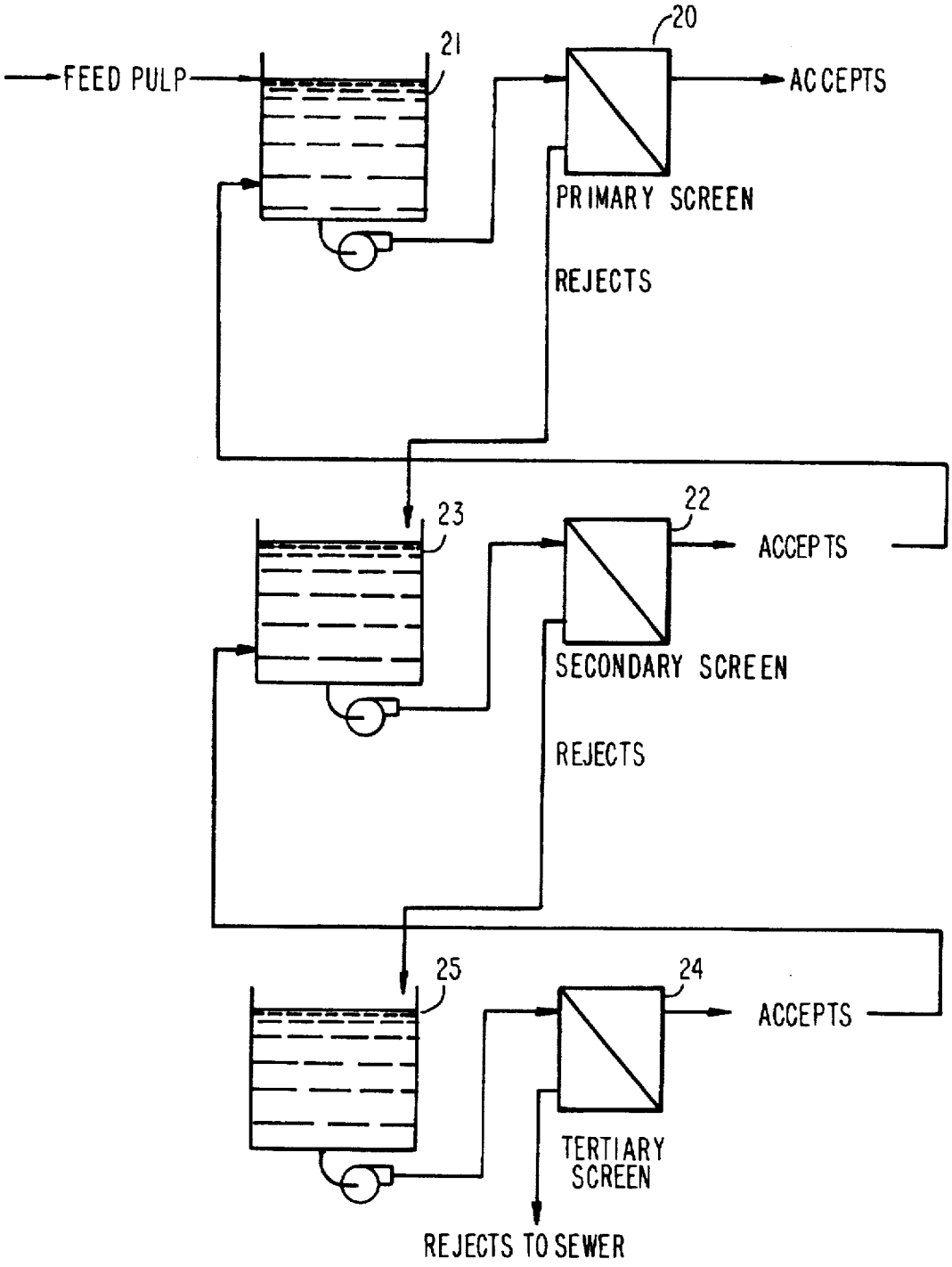
FIG. 1B PRIOR ART
FIG. 1*b* is a schematic diagram of a conventional design for a pressure screening system employing successive screening stages for recovering additional fiber from the rejects stream.

The system of the invention as described above can achieve good recoveries of residual fiber and separation of contaminants so as to eliminate the need for complex multiple screen stage systems such as are used conventionally. In FIG. 1*b*, a conventional multi-stage screen system is shown having primary screen 20, secondary screen 22, and tertiary screen 24, and respectively associated feed tanks 21, 23, 25. The accepts stream is taken from the primary screen 20, while its rejects stream is input to the feed tank 23 of the secondary screen 22. The accepts stream from the secondary screen 22 is fed to the feed tank 21 for the primary screen, while its rejects stream is further refined by feeding it to the feed tank 25 of the tertiary screen 24. The accepts stream from the tertiary screen 24 is fed to the feed tank 23 for the secondary screen, while its rejects stream is discharged to the sewer.

When conventional screening technology is used, series screening can be prohibitively expensive because of the redundancies of equipment for the secondary, tertiary, and even quarternary screens used. However, series screening in the invention is lower in cost and has a simple operation because only one feed tank and pump are sufficient for the entire screening system.

For comparison, the conventional system will have screen reject rates of about 25% (by weight of fiber) for a primary screen, and 30% for a secondary or tertiary screen. Therefore, the final reject rate for the conventional tertiary system in FIG. 1*b* is 0.25×0.30×0.30, or about 2.25%. On the other hand, the invention system in FIG. 1*a* will have a reject rate of 1.25%, equal to 0.25×0.05, because the fiber loss in the rejects overflow of the flotation section is only about 5%.

Figure 4:
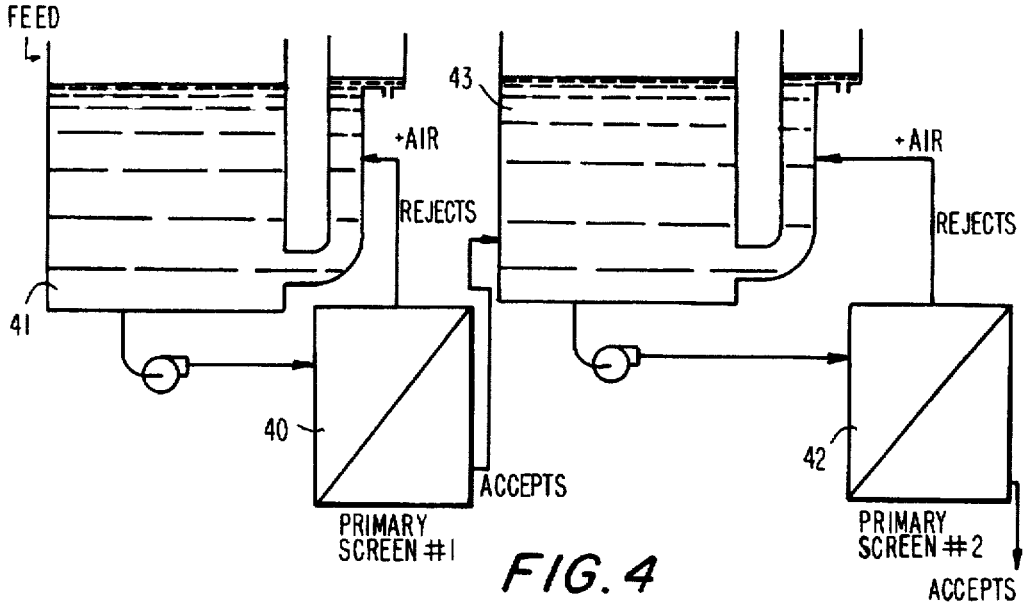
FIG. 4 is a schematic diagram of a pressure screening system employing multiple pressure screen stages and respective feed tanks with flotation sections for cycling back their respective rejects streams.

In FIG. 4, another multi-stage pressure screen system in accordance with the invention employs separate feed/flotation tanks 41 and 43 for primary screens 40 and 42, respectively. High levels of residual pulp recovery and efficient removal of contaminants can be obtained comparable to conventional systems employing tertiary or more stages.

Figure 5:
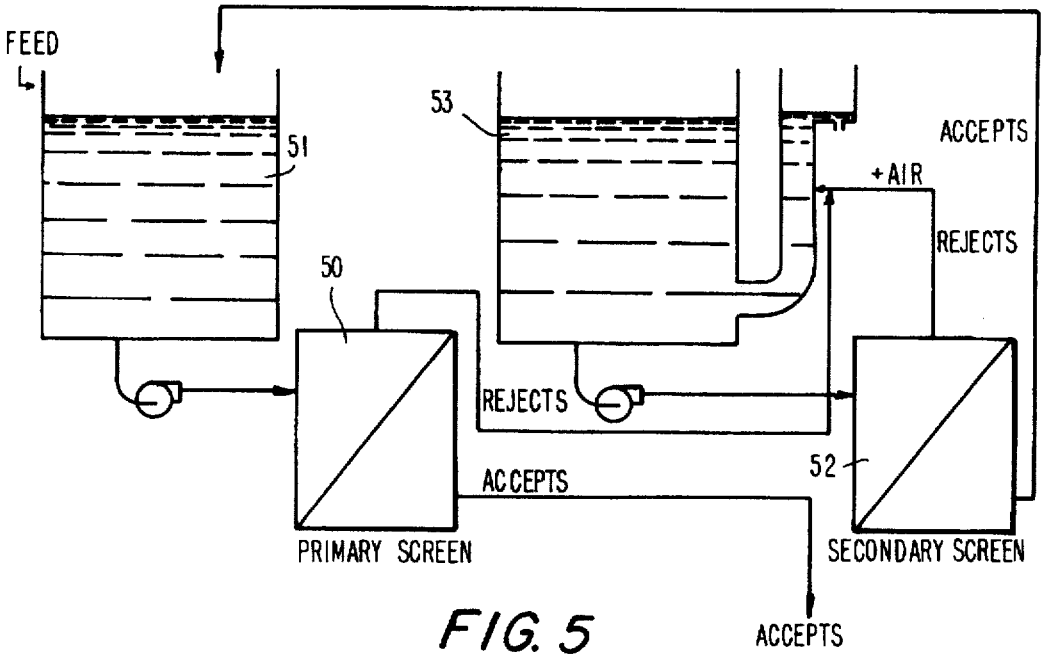
FIG. 5 is a schematic diagram of a further embodiment of a pressure screening system employing multiple pressure screen stages.

In FIG. 5, another system configuration is shown in which a conventional feed tank is used for the input to the primary screen 50, while a feed/flotation tank 53 is used as described above for recovery of residual pulp from the rejects stream of the secondary screen. The accepts from the primary screen are taken as accepts output. The accepts from the secondary screen are taken as inputs to feed tank 51.

Any suitable type of flotation section may be used for cycling back fiber from the rejects stream to the feed tank. A very simple and effective device is a standpipe attached to the side of the screen feed tank. The fluid level is controlled by the level in the feed tank. The froth and contaminants are overflowed from the top of the standpipe with very little loss of pulp in the overflow.

A normal fiber reject rate for the screen rejects stream is in the range of 3–30%, or can be in the range of 1–40%. The consistency of the rejects stream entering the flotation section is preferably in the range of 0.4–3.0%, and more preferably 0.6–2.0%. An excessively high pulp consistency will reduce the effectiveness of contaminant removal in the foam layer. Dilution water may be introduced into the standpipe adjacent the rejects stream inlet in order to lower and control the pulp consistency and increase the flow velocity and froth.

Experimentation has shown that the volume of air can be varied over a wide range with good results. A convenient method of expressing the air usage is SCFM (standard cubic feet per minute) of air flow for a certain flow of accepts from the screen. For example, tests using a screen having an accepts flow of 400 gpm showed optimum results when the amount of air introduced was in the range of 5–10 SCFM. However, lower or higher air volumes can also be used with good results. In some systems, the amount of air entrained in the pulp by pumping and mixing in storage tanks is sufficient by itself, with no further air addition. Another alternative which avoids having to use an air compressor is to add air at atmospheric pressure to the suction of the screen feed pump.

Preferably a flotation deinking chemical is present in the screen rejects stream sent to the flotation section. The flotation chemical makes the contaminants more hydrophobic so that they become more strongly attached to the air bubbles, and more effectively removed in the flotation section. The flotation chemical also increases the amount of foam in the flotation section, so that the froth and contaminants can be overflowed without a significant loss of pulp fiber. The chemical can be introduced into the pulp feed prior to input to the pressure screen, or into the pressure screen itself, or into the screen rejects stream before it enters the flotation section. Agglomeration deinking chemicals can also be used, because these chemicals also make the contaminants more hydrophobic. In some cases, addition of alkali (typically sodium hydroxide) will liberate coating binders and other materials from recycled or contaminated pulps. These materials will act as foaming agents and flotation deinking agents so that addition of other chemicals is not required. Even if no chemical is used at all, the flotation method of the invention is effective for contaminant removal because many of the contaminants are naturally hydrophobic (e.g., stickies, wax, plastic, hot melt adhesives).

The method of the invention can remove large contaminants, and also small contaminants such as stickies, ink, small hot melt particles, small particles of plastic, or colloidal materials such as wax which cannot be removed using conventional screening. Normally the pulp would be prescreened with a coarse screening device for removal of large, easily removable contaminants, and processed through a centrifugal cleaning device for removal of heavy particles such as sand and grit, before being screened using the method of the invention. This type of abrasive material is removed to avoid wear and damage to the screen apparatus. A centrifugal cleaning device can be located between the screen feed pump and the screen inlet, or can be located earlier in the system prior to the screen feed tank.

The method of the invention can be used on the main stream pulp flow in a pulp processing system, or can be used to recover the fiber and to concentrate the contaminants in any reject stream from the system. Reject streams normally contain more pulp fiber than actual contaminant materials, and the invention can be used to reduce the fiber losses. The invention may be used in processing any type of contaminated pulp fiber, such as recycled fiber or contaminated virgin fiber, including unbleached brown fiber, white fiber, groundwood, newsprint, or any mixture of fiber types.

There are three preferred tank designs as indicated above: (a) the feed tank is equipped with a standpipe on the side, and the screen rejects enter in the standpipe; (b) there is a separate flotation cell for entry of the screen rejects prior to entering the feed tank; and (c) the screen rejects can be introduced directly into the feed tank. In the case of a standpipe, a small-diameter standpipe is preferred and a controlled volume overflow is provided with room for expansion at the top. There must be enough entrained air to ensure flotation of the contaminant-carrying froth, and air may be added into the rejects stream or near the secondary input to the flotation tank for the rejects stream or into the flotation tank itself. Provision may also be made for handling surges of feed stock demand and possible upset conditions in the pressure screen. A suitable flotation chemical may be added to the feed tank to make the contaminants more hydrophobic so that they become more strongly attached to the air bubbles and to increase the amount of foam. Similar considerations apply in the case of a separate flotation cell.

The standpipe should be designed with a sufficient diameter that the downward velocity of the pulp in the pipe will be no greater than 0.5 ft/sec. This insures that air bubbles in the rejects stream will not be carried down with the pulp as it moves downward in the standpipe, but will come to the top of the standpipe with the contaminants. The height of the standpipe is typically about the same as the height of the feed tank, but the overflow level of the standpipe is below the overflow of the feed tank, as indicated in FIG. 1*a*. A water spray can be used to push the foam and contaminants to the standpipe overflow. The standpipe level can also be a different height from the height of the screen feed tank if the level control in the standpipe is independent of the level control in the screen feed tank. This can be achieved by using a control valve between the standpipe and the feed tank, and using independent dilution water addition in the standpipe and in the feed tank, or by pumping from the standpipe to the feed tank.

In order to maintain adequate control of the pulp level in the feed tank, the retention time in the tank should be at least 1 minute, and preferably at least 2 minutes. A good retention time would be in the range of 2–10 minutes. Longer retention times provide better insurance against feed tank overflowing or going empty, but a larger tank is more expensive and requires more floor space. The screen feed tank is typically at least 8 feet high to allow adequate level control, but is often 8–10 feet high or even higher.

In the case where screen rejects can be introduced directly into the feed tank, the feed tank must be equipped with a method for removing floating contaminants from the surface. Possible methods for doing this include using a floating suction device, or a stationary suction device, or a rotating paddle device to push the floating contaminants over a weir into a reject trough, or a vertical reject pipe in the center of the tank where the floating rejects can overflow into a collection sump. Of these removal methods, the last three rely on accurate level control in the tank, whereas the floating suction device does not. Level control can be achieved by controlled injection of dilution water into the tank.

Numerous modifications and design variations may of course be devised given the above-described principles of the invention. It is intended that all such modifications and variations be considered as within the spirit and scope of this invention, as it is defined in the following claims.

I claim:

1. A pressure screening system comprising:

a pressure screen apparatus having an inlet for an input feed of a pulp fiber slurry; a screen member for separating an accepts stream of clean fiber, which passes through said screen member, from a rejects stream carrying contaminants, which does not pass through said screen member, and a feed tank apparatus having a feed tank, said feed tank includes a primary input for a feed stock of pulp fiber and an output for supplying said pulp fiber slurry to said inlet of said pressure screen apparatus, wherein said feed tank apparatus includes a flotation section, said flotation section having a lower end in communication with the feed tank, said flotation section includes a secondary input for receiving said rejects stream of the pressure screening system fed together with air for generating a froth, said flotation section includes means for separating a rejects overflow of contaminants as said froth from the remainder of the feed stock for recovery of additional pulp fiber from the rejects stream.

2. A pressure screening system according to claim 1, having means to entrain air in said input feed to said pressure screen apparatus such that air is contained in said rejects stream fed to said secondary input to said flotation section.

3. A pressure screening system according to claim 1, having means for introducing air to said flotation section.

4. A pressure screening system according to claim 1, having means for drawing off the froth generated by the air in said flotation section carrying a high concentration of contaminants as the rejects overflow from said flotation section.

5. A pressure screening system according to claim 1, wherein said flotation section is a standpipe hydraulically connected to said feed tank.

6. A pressure screening system according to claim 1, wherein said flotation section is a separate flotation cell hydraulically coupled to said feed tank.

7. A pressure screening system according to claim 1, wherein said flotation section has an input for receiving said rejects stream therein and a contaminant removal device for removing floating contaminants.

8. A pressure screening system according to claim 7, wherein said contaminant removal device is one selected from the group consisting of a floating suction device, a stationary suction device, a rotating paddle device to push floating contaminants over a weir into a reject trough, and a vertical reject pipe in the center of the tank where the floating rejects overflow into a collection sump.

9. A pressure screening system according to claim 1, wherein said flotation section includes means for injection of dilution water for controlling the consistency of said rejects stream.

10. A pressure screening system according to claim 9, wherein said means for injection of dilution water is used to provide a preferred consistency of said rejects stream in the range of 0.4–3.0%.

11. A pressure screening system according to claim 1, wherein said feed tank apparatus provides the input feed of said pulp fiber slurry to a primary pressure screen apparatus, and the rejects stream from said primary pressure screen apparatus is fed to said flotation section of said feed tank.

12. A pressure screening system according to claim 1, having a feed tank which provides an input feed of said pulp fiber slurry to a first primary pressure screen apparatus, said first primary pressure screen apparatus provides an accepts stream as an input feed to a second primary pressure screen apparatus, the rejects streams from both pressure screen apparatuses are fed to said flotation section of said feed tank apparatus, and said accepts stream from said second primary pressure screen apparatus is taken as an output accepts stream.

13. A pressure screening system according to claim 1, having a first and second feed tank apparatuses and said first feed tank having a first feed tank which provides an input feed of said pulp fiber slurry to a first primary pressure screen apparatus, which in turn provides an accepts stream as an input to a second feed tank, which in turn provides an input feed to a second primary pressure screen apparatus, the rejects stream from each pressure screen apparatus is fed to said flotation section of their respective feed tank apparatuses, and said accepts stream from said second primary pressure screen apparatus is taken as an output accepts stream.

14. A pressure screening system according to claim 1, having a first feed tank which provides an input feed of said pulp fiber slurry to a primary pressure screen apparatus, a second feed tank apparatus having a second feed tank which provides an input feed of said pulp fiber slurry to a secondary pressure screen apparatus, the rejects streams of both pressure screen apparatuses are fed to said flotation section of said second feed tank, and the accepts stream from said primary pressure screen apparatus is taken as an output accepts stream, while said accepts stream from said secondary pressure screen apparatus is sent back to said first feed tank.

15. A feed tank apparatus for supplying a pulp fiber slurry to a pressure screen apparatus, comprising:

a feed tank having a primary input for receiving a feed stock of a pulp fiber;

said feed tank further having an output for supplying said pulp fiber slurry to the pressure screen apparatus; wherein the pressure screen apparatus has an inlet for an input feed of said pulp fiber slurry; a screen member for separating an accepts stream of clean fibers, which passes through said screen member, from a rejects stream carrying contaminants, which does not pass through said screen member; and a flotation section, said flotation section having a lower end in communication with the feed tank at a lower end portion of the feed tank, said flotation section includes a secondary input for receiving said rejects stream from the pressure screen apparatus together with air for generating a froth, said flotation section includes means for separating a rejects overflow of contaminants as said froth from the remainder of said feed stock.

16. A feed tank apparatus according to claim 15, having means for introducing air to said flotation section.

17. A feed tank apparatus according to claim 15, having means for drawing off the froth generated by the air in said flotation section carrying a high concentration of contaminants as the rejects overflow from said flotation section.

18. A feed tank apparatus according to claim 15, wherein said flotation section is a standpipe hydraulically connected to said feed tank.

19. A feed tank apparatus according to claim 15, wherein said flotation section is a separate flotation cell hydraulically coupled to said feed tank.

20. A feed tank apparatus according to claim 15, wherein said flotation section has an input for receiving said rejects stream therein and a device for removing floating contaminants.

* * * * *